US007163317B2

(12) United States Patent
Warnecke et al.

(10) Patent No.: US 7,163,317 B2
(45) Date of Patent: Jan. 16, 2007

(54) COLOR-CHANGING APPARATUS, AND ASSOCIATED METHOD, FOR A LIGHT ASSEMBLY

(75) Inventors: Russell A. Warnecke, Colorado Springs, CO (US); Kenneth R. Fasen, Colorado Springs, CO (US)

(73) Assignee: Wybron, Inc., Colorado Springs, CO (US)

( * ) Notice: Subject to any disclaimer, the term of this patent is extended or adjusted under 35 U.S.C. 154(b) by 230 days.

(21) Appl. No.: 10/804,572

(22) Filed: Mar. 19, 2004

(65) Prior Publication Data

US 2005/0018423 A1 Jan. 27, 2005

Related U.S. Application Data

(60) Provisional application No. 60/488,848, filed on Jul. 21, 2003.

(51) Int. Cl.
*F21V 9/00* (2006.01)

(52) U.S. Cl. ..... 362/281; 362/230; 362/268; 362/283

(58) Field of Classification Search ..... 362/268, 362/283, 293; 359/888–889
See application file for complete search history.

(56) References Cited

U.S. PATENT DOCUMENTS 4,459,014 A 7/1984 Thebault
4,894,760 A 1/1990 Callahan
4,914,556 A 4/1990 Richardson
4,958,265 A 9/1990 Solomon
4,984,143 A 1/1991 Richardson
5,126,886 A * 6/1992 Richardson et al. ..... 359/888
5,188,452 A 2/1993 Ryan
5,515,254 A * 5/1996 Smith et al. ..... 362/293
5,969,868 A 10/1999 Bornhorst et al.
6,142,652 A 11/2000 Richardson
6,379,025 B1 * 4/2002 Mateescu et al. ..... 362/293
6,466,372 B1 * 10/2002 Morris et al. ..... 359/567
6,502,961 B1 * 1/2003 Richardson ..... 362/268
6,578,987 B1 6/2003 Hough et al.
6,687,063 B1 2/2004 Rasmussen et al.
6,796,682 B1 9/2004 Hough et al.
6,796,683 B1 9/2004 Wood et al.
6,811,286 B1 * 11/2004 Mateescu et al. ..... 362/293
6,974,232 B1 * 12/2005 Richardson ..... 362/293

* cited by examiner

*Primary Examiner*—Sandra O'Shea
*Assistant Examiner*—Anabel Ton

(57) ABSTRACT

Color-changing apparatus, and an associated method, for a lighting assembly. One or more dichroic filters are selectably positioned in the path of a light beam generated by a light source. A positioner supportively positions the dichroic filter and effectuates its translation into and out of the path of the light beam. A set of dichroic filters, each separately supported by a separate actuating positioner permits a combination of dichroic filters to be combined to cause the light color of the light beam to be of any desired color.

30 Claims, 4 Drawing Sheets

COLOR-CHANGING APPARATUS, AND ASSOCIATED METHOD, FOR A LIGHT ASSEMBLY

CROSS-REFERENCE TO RELATED APPLICATIONS

The present application claims the priority of Provisional Application No. 60/488,848, filed on Jul. 21, 2003, the contents of which are incorporated herein.

The present invention relates generally to a manner by which to illuminate a target with a light beam of a selected color. More particularly, the present invention relates to apparatus, and an associated method, by which to select, and selectably change, the color of the light beam. The dichroic filters comprise, e.g., a set of cyan-, magenta-, and yellow-colored filters, each having saturation gradations that change linearly along the lengths of the filters. The filters are linearly translatable to position any of the filters, at any saturation gradation, in the path of the light beam to cause the light beam to be of the selected color.

The selected color is easily changeable through simple linear movement of any of the filters, and the use of dichroic filters provides a heat-tolerant, long-lasting, color-changing mechanism.

BACKGROUND OF THE INVENTION

Electrical lighting equipment is pervasively used in modern society to generate light energy. The light energy provides illumination by which to illuminate an area.

The illumination provided by the lighting equipment is used, many times, for functional purposes. Activities that require light for their effectuation are able to be performed when the lighting equipment is used to illuminate an appropriate area.

Lighting equipment is sometimes also utilized for aesthetic purposes. That is to say, illumination of an area sometimes also provides aesthetic improvements to the lighted areas, as well as, perhaps also, adjacent areas to the lighted areas. And, the electrical lighting equipment is used to generate light energy to provide illumination that serves both functional and aesthetic purposes.

Electrical light sources convert electrical energy into light energy. A byproduct of the conversion is heat energy. The light energy generated by many conventional electrical light sources appears to be white in color, and the light energy is referred to as being white light. The color of the light energy projected towards a target to illuminate the target might, however, sometimes be preferred to be of a color other than the white color of the white light.

Lighting equipment that is utilized for stage lighting purposes, that is, to illuminate a target on a theatrical, or other, stage, might preferably be of a light colors other than the white light conventionally generated by many conventional electrical light sources that form, conventionally, parts of stage lighting equipment. Other lighting equipment similarly might preferably be of a light color other than the white light of the light energy initially generated by the light source.

To alter the color of the light, a light filter is placed in the path of the light energy, i.e., the light beam, to alter the color of the light. By placing a color filter in the path of transmission of the light energy, the light filter filters a component portion of the light energy, thus altering the color of the light. Through suitable selection of the light filter characteristics, light of a desired color is formed.

Typically, when the lighting equipment is used for stage lighting purposes, the color of light that is desired to illuminate a target changes. That is to say, a sequence, or series, of different light colors are desired to illuminate a target during successive intervals. Change of the light filter characteristics is required to change the light color during the successive intervals. When the lighting equipment is used for stage lighting during a performance, sometimes the light color must be changed many times during a stage performance. When the characteristics are changed, the changes must be effectuated quickly. Light filters that filter components of white light to form the colored light must correspondingly quickly changed.

Most simply, lighting equipment utilized for stage lighting in which the color of the light directed towards a target is to be filtered, manual switching of the light filter is performed each time in which the color of the light is to be changed. A lighting operator positions the filter in the path of the light beam and successively changes the filter, or its characteristics, when the color of the light is to be changed. Each time in which the light color of the light is to be changed, the stage lighting operator is required manually to remove a light filter and replace it with another, or otherwise alter the characteristics of the filter, each time in which a light color change is to be made.

Manual operations are necessarily labor-intensive. Additionally, manual changes are prone to human error. Rehearsal of the light filter change sequence is also typically required of the stage lighting operator to rehearse the necessary changes.

Various apparatus and mechanisms by which to automate the procedure by which to change the light filters are sometimes implemented. For instance, U.S. Pat. No. 6,142,652 discloses a lighting device that includes a light filter having filter elements rotatably positionable in an optical path to filter light projected along the optical path.

Conventional light filters are sometimes formed of a gel material. While effective to form the filters, gel material is susceptible to damage of a prolonged exposure to heat, such as the heat generated as a byproduct of the lighting equipment. While filter elements formed of dichroic materials are available, their use, to date, has been limited. Dichroic filters are advantageous for the reason that such filters do not suffer from the effects of heat degradation to the extent that gel materials do.

If color changing apparatus could be provided that utilizes dichroic filters while permitting the light colors of light generated by lighting equipment to be quickly, and automatically, made, an improved lighting assembly would be provided.

It is in light of this background information related to color-changing lighting equipment that the significant improvements of the present invention have evolved.

SUMMARY OF THE INVENTION

The present invention, accordingly, advantageously provides apparatus, and an associated method, by which to illuminate a target with a light beam of a selected color.

Through operation of an embodiment of the present invention, a manner is provided by which to select, and selectably change, the color of the light beam.

A light beam is generated by a light source that is directed towards the target to illuminate the target. One or more dichroic filters are selectably positioned in the path of the light beam generated by the light source. The dichroic filters exhibit light filter characteristics for passing component portions of the light beam and reflecting, i.e., rejecting, other component portions of the light beam. When the filter is positioned in the path of the light beam, the light energy of the light beam is filtered to produce a filtered light beam that exhibits a color defined by the light components passed by the dichroic filter.

When more than one filter is positioned in the path of the light beam, the light generated by the light source is successively filtered by the filters that are placed in the path of its propagation. The resultant, filtered light is of color characteristics defined by the combination of all of the filters placed in the path of the light beam. Through appropriate selection of the filters that are positioned in the path of the light beam, the color of the resultant, filtered light beam is of a desired color.

When, for instance, a set of at least three filters are selectably positionable in the path of the light beam, the filters including a cyan-, a magenta-, and a yellow-color, any secondary color of light is formable through appropriate combination of the filters of the three primary color-types.

Each of the dichroic filters is of saturation gradations that change linearly along its length. That is to say, the saturation gradation of the color saturation of the filter is dependent upon where along the length of the filter that the saturation gradation is measured. The filter characteristics of the filter, correspondingly, are dependent upon which portion of the filter is positioned in the path of the light beam. And, the resultant color changing of the light is dependent upon which portion of the filter through which the light is projected. When a set of dichroic filters, each exhibiting the saturation gradations that change in respective linear directions of the separate dichroic filters, an increased number of shades of colors is formable through appropriate combination of the filters, at selected saturation gradations, that are placed in the path of the light beam.

A positioner is associated with each of the filters. Each positioner supportively positions the filter with which the positioner is associated, selectably to be in the path of the light beam. The positioner associated with a filter positions the filter to extend in a direction substantially perpendicular to the axial direction in which the light beam is projected. The positioner further includes a linear translator selectably for translating the filter into the path of the light beam to position a selected portion of the filter in the path of the light beam. Because the saturation gradations of the color of the filter changes in a linear direction, linear translation of the filter caused by the positioner causes the light sourced at the light source and directed through the filter to be of desired color characteristics. Two-directional, i.e., forward and reverse directional movement, selectably to reposition the filter into, or out of, the path of the light beam, or to change the portion of the filter through which the light beam is projected.

When a set formed of a plurality of filters is positioned proximate to the light beam generated by the light source, in one implementation, all of the filters are positioned by positioners at a common side of the light beam. When a positioner subsequently translates an associated filter in a direction to position the filter in the path of the light beam, by translation of the respective filters in a common direction into the path of the light beam. In another implementation, the positioners position the respective filters at other orientations relative to the light beam.

A housing assembly is formed pursuant to an embodiment of the present invention by which to illuminate a target, such as a stage performer, with a light of any selected color. A plurality of dichroic filters is selectably positionable in the path of a light beam generated by a light source forming part of the lighting assembly. The dichroic filters are selectably positioned in the path of the light beam through actuation of translating actuators that linearly position the filters in the path of the light beam. The filters exhibit saturation gradations that change in linear directions so that the linear translations of the respective ones of the filter position at the selected portion of the associated filter in the path of the light beam. Through appropriate selection of the dichroic filters, and the saturation gradations of the colors of such filters, any desired light color is formable. And, because the filters are translatable through simple linear motion caused by translation actuators, the colors are quickly and easily changeable. Additionally, through the use of dichroic filters, long-lasting filters are provided, operable without change or failure at high temperatures, such as those associated with high wattage light sources.

In these and other aspects, therefore, a color changing apparatus, and an associated method, is provided for a light assembly. The light assembly has a light source that generates a light beam in an axial direction. The light beam illuminates a target. At least a first filter flag is formed of a first color. The first filter flag exhibits, along at least a portion of a length thereof, a first range of first color-saturation gradations in the first color. At least a first filter-flag positioner supportively positions at least a first filter flag at an angle offset from the axial direction of the light beam. The first filter-flag positioner translates the first filter flag selectively to position a selected portion thereof in the light beam. A light beam characteristic of the light beam is dependent upon which, if any, portion of the first filter flag forms the selected portion selectably positioned in the light beam.

A more complete appreciation of the present invention and the scope thereof can be obtained from the accompanying drawings that are briefly summarized below, the following detailed description of the presently-preferred embodiments of the present invention, and the appended claims.

BRIEF DESCRIPTION OF THE DRAWINGS

FIGS. 4-1, 4-2, 4-3, 4-4, and 4-5 illustrate various views of a positioner and translator that form a portion of the color-changing apparatus of an embodiment of the present invention.

FIG. 5 illustrates a perspective view of a lighting assembly that includes the color-changing apparatus of an embodiment of the present invention.

DETAILED DESCRIPTION

Figure 1:
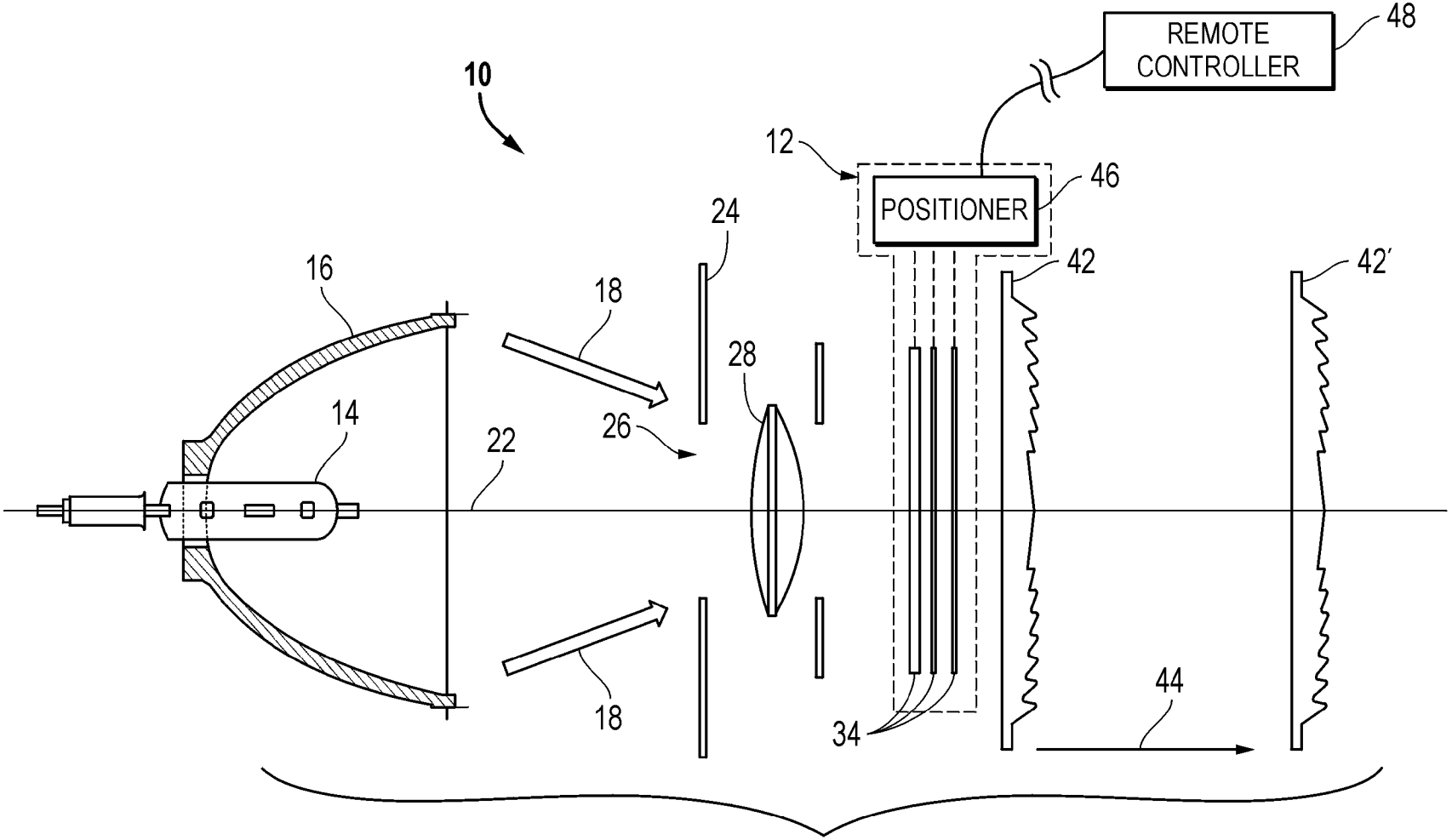
FIG. 1 illustrates an exploded, functional view of a housing assembly that includes the color-changing apparatus of an embodiment of the present invention as a portion thereof.

Referring first to FIG. 1, a housing assembly, shown generally at 10, includes color-changing apparatus 12 of an embodiment of the present invention. The housing assembly operates to generate a light beam capable of being projected upon a target, such as a stage performer, to illuminate the target by directing the light beam generated by the light assembly at the target. The housing assembly is, for instance, permitting of adjustment to permit the direction in which the light beam is projected to be altered, such as to follow the movement of a stage performer across a stage. And, the housing assembly is constructed, variously to form any desired type of lighting device, such as a wash light, a spot light, a profile light, or a hard-edged light.

The light assembly includes a light source 14, here a filament lamp 14. The light source is coupled to an external supply (not shown) of electrical power, and the light source operates to transduce electrical energy provided thereto into light energy. Because the conversion is not completely efficient, a portion of the electrical energy is converted into heat energy. The light that is generated by the light source is generated, e.g., across a substantial portion of the visible light frequencies, thereby to be of a white color, i.e., white light. Here, the light source is positioned at an end part of a parabolic or elliptical reflector 16 that operates to reflect light incident thereon in reflected direction, some of which are indicated by the paths 18.

The light energy that is generated by the light source is propagated directly, or reflected off the reflector 16 to propagate in a direction generally corresponding to an axial direction indicated by the line 22. A plate member 24 having a central aperture 26 centered about the axial path 22 is positioned at a set-apart position from the light source and reflector. Light energy that is propagated in directions to extend through the aperture 26 is incident upon a lens 28. The lens redirects the light energy incident thereon, thereafter to be propagated, generally, in directions parallel to the direction of the axial path 22. The light energy is then incident upon one or more color filters 34 that are selectably positioned pursuant to operation of an embodiment of the present invention in the path of the incident light of the light beam. Here three filters 34 are used. In other implementations, other numbers are used. While the functional representation shown in the Figure illustrates the positioner to operate at a single side of the housing assembly, in alternate implementations, the positioners are positioned in other configurations, such as at opposing sides of the assembly. And, in other implementations, the filters form dimmer functions by selectably blocking light energy.

The color filter, depending upon its characteristics, passes selected component frequencies of the light energy of the light beam incident thereon and reflects, or otherwise prevents, further propagation of the light energy that is outside of the range of frequencies within the passband of the color filter. More than one color filter is positionable, if desired, in the path of the incident light. Such color filters are successively arranged, to be positioned one after another so that successive filtering is performed upon the light beam as the light beam is incident upon successive ones of the filters. Through appropriate selection of the filter characteristics of the successive ones of the filters, the resultant light color of the light beam is of any selected color of a wide range of colors. The light beam, once filtered to be of a selected color, is then directed through a second lens 42 that further shapes the light beam to project the light beam in a desired manner, such as, for example, cause the light beam to exhibit a hard-edge or a soft-edge, subsequently to be directed towards the target that the light assembly is to illuminate. The lens 42 is translatable, such as in directions indicated by the arrow 44, into another position, here represented by the lens 42', the position of the lens is, in part, determinative of the lighting characteristics exhibited by the assembly.

The apparatus 12 also includes a positioner 46 for positioning the color filter or filters 34 in the path of the light beam, once the light beam passes through the lens 28. The positioner operates to effectuate linear translation of the filter with which the positioner is associated, selectably to position the filter with which the positioner is associated in the path of the light beam, at a selected location along the length of the filter, or, alternately, out of the path of the light beam. The positioner in the implementation shown in the Figure is remotely actuated by a remote controller 48, such as a computer work station. In other implementations, the positioner is locally actuated or manually actuated.

Figure 2:
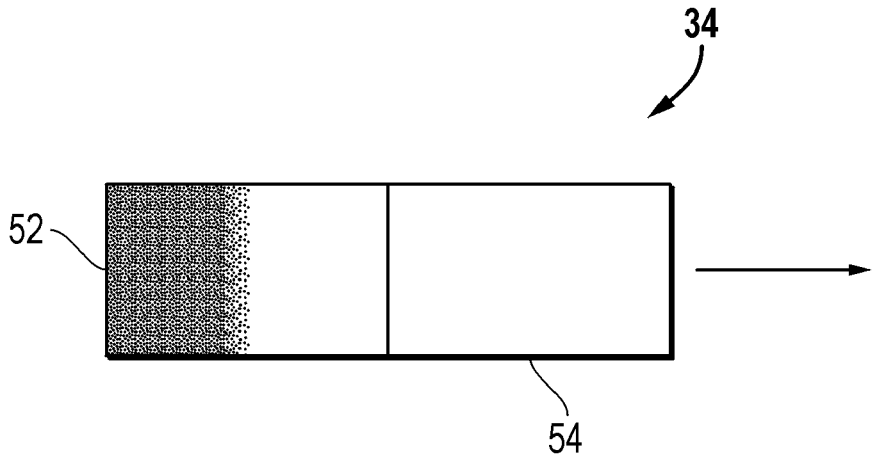
FIG. 2 illustrates a representation, in side-elevational view, of an exemplary dichroic filter that forms a portion of the color-changing apparatus of an exemplary implementation of an embodiment of the present invention.

FIG. 2 illustrates an exemplary filter 34 forming a portion of the housing assembly 10, shown in FIG. 1. The filter is formed of a dichroic material, a heat-tolerant and long-lasting material of a selected color, such as magenta, cyan, or yellow. The filter exhibits a saturation gradation that changes in a linear direction, indicated by the line 48. The filter is here shown to be formed of a first part 52 and a second part 54. The first portion 52 forms the portion of the filter that exhibits the saturation gradations that change in the linear direction indicated by the line 48. And, the second portion 54 of the filter forms a saturated area of a fully saturated color. In the exemplary implementation, each portion 52 and 54 is of a length of approximately 2.5 inches. When supported by the positioner 38 (shown in FIG. 1), the positioner operates selectably to translate the filter to position a selected portion, i.e., the portion 52 or 54 in the path of the light beam. If the portion 52 is positioned in the path of the light beam, precise positioning of the filter by the positioner causes the filter to be positioned such that the light beam is incident upon an area of a selected gradation of color. When multiple filters, each supportively positioned by separate positioners, secondary colors of selected shades and hues are formable. And, when the filter functions to perform dimmer functions, the selected gradations are of gradations of opaqueness.

Figure 3:
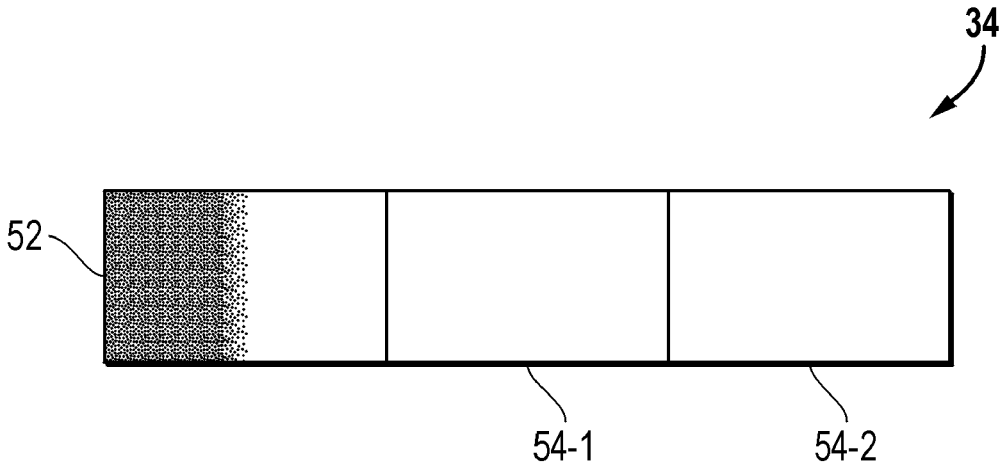
FIG. 3 illustrates a representation, similar to that of FIG. 2, here of another dichroic filter, also forming a portion of the color-changing apparatus of another embodiment of the present invention.
Figures 1, 4:
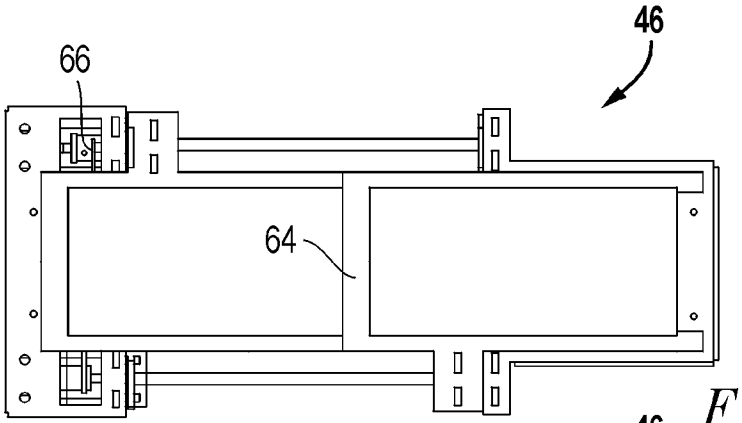
Figures 2, 4:
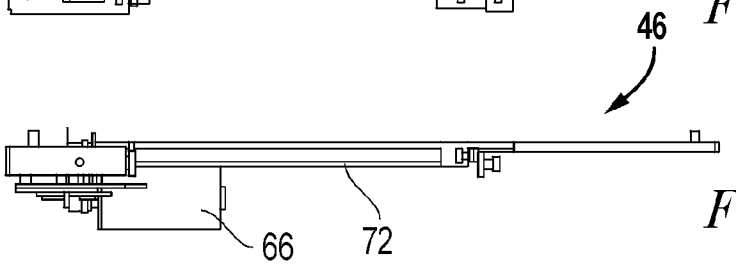
Figures 3, 4:
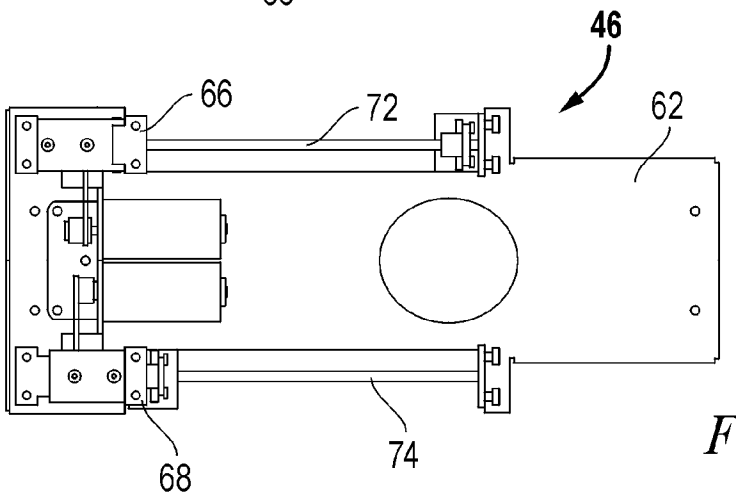
Figure 4:
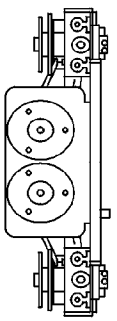
Figures 4, 5:
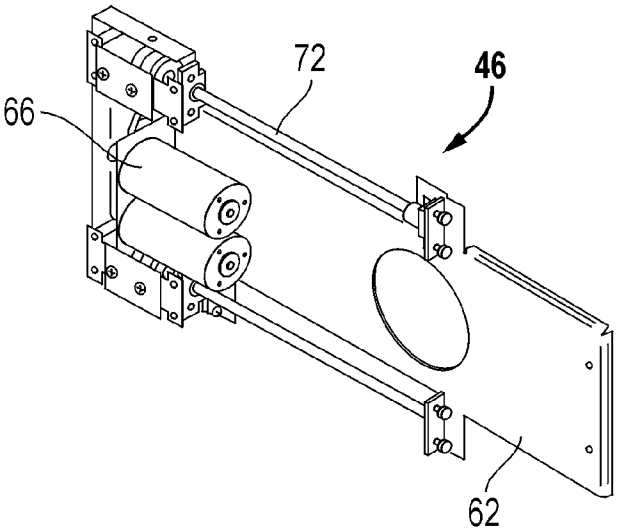
Figure 5:
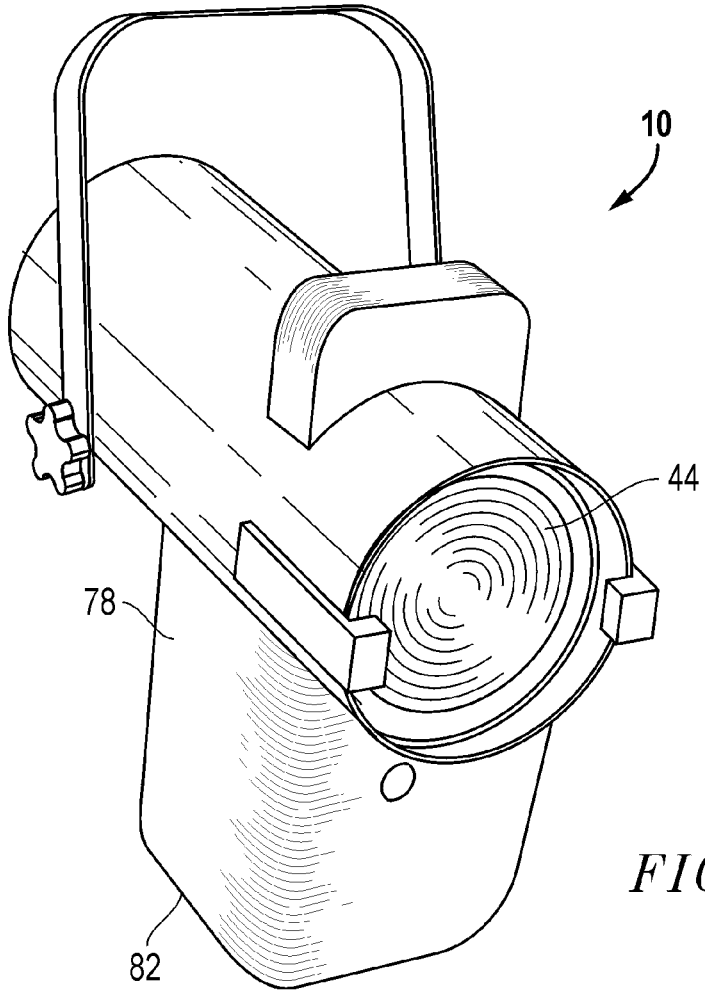

FIG. 3 illustrates another dichroic filter 12 that selectably forms a portion of an embodiment of the present invention. Here, the filter is formed of a first portion 52 and two separate section portions 54, here represented at 54-1 and 54-2. The separate portions 54-1 and 54-2 are each fully saturated portions, but exhibit different color centers and cutoff slopes of a color. The filter shown in FIG. 3 is also supported by a positioner 38 (shown in FIG. 1) pursuant to operation of an embodiment of the present invention to position any of the portions of the filter, or a particular area of the portion 52, of the filter in the path of the light beam generated by the housing assembly 10, shown in FIG. 1.

FIGS. 4-1, 4-2, 4-3, 4-4, and 4-5 illustrate various views of the positioner 38 of an embodiment of the present invention. The positioner supportively positions a dichroic filter 34 (shown in FIGS. 1–3) and selectably translates the dichroic filter in a linear direction to position a selected portion of the filter in the path of a light beam generated by the housing assembly. In the exemplary implementation, the positioner includes a base member 62 upon which a filter frame member 64 is slidably positioned. Sliding translation of the frame 64 is permitted in a linear direction. Here, the frame is C-shaped and is of dimensions permitting seating of a dichroic filter therein. In the view of FIG. 1, a dichroic filter 34 is supported in position by the frame member 64.

The positioner further includes translating actuators 66 and 68 having lead-screw extension arms 72 and 74, respectively, that are affixed at ends thereof to opposing sides of the frame member 64. The translating actuators are formed of electrical motors capable of inducing rotation of the lead screws to cause linear translation of the screws and, in turn, the frame member to which the lead screws are attached. Two-way movement of the filter in forward and reverse linear directions to position a desired portion, or area thereof, in the path of a light beam. When the color that the light beam is to exhibit changes, the translating actuators are caused to be operated responsive thereto to effectuate a change in the color.

In the exemplary implementation, three, or more, positioners, each containing a separate dichroic filter, are cascaded, one after the other, so that a light beam is caused to be passed through successive ones of the filters. Through appropriate selection of the filters, any selected color of light is formable.

FIG. 5 illustrates again the housing assembly 10 of an exemplary embodiment of the present invention. Here, in perspective view, the housing assembly is positioned to project a light beam towards a target (not shown) thereby to illuminate the target. The elements of the housing, shown previously in the exploded view of FIG. 1, are housed within a housing 78. The lens 44 through which the light beam is projected extends to a surface of the housing. The positioners 38 (shown in FIGS. 1 and 4) are all housed within the housing section 82 to position the dichroic filter supported therefrom at the same side of the light beam. Actuation of the translating actuators of the positioners cause the respective filters selectably to be positioned in the path of the light beam within the housing of the light assembly.

Figure 6:
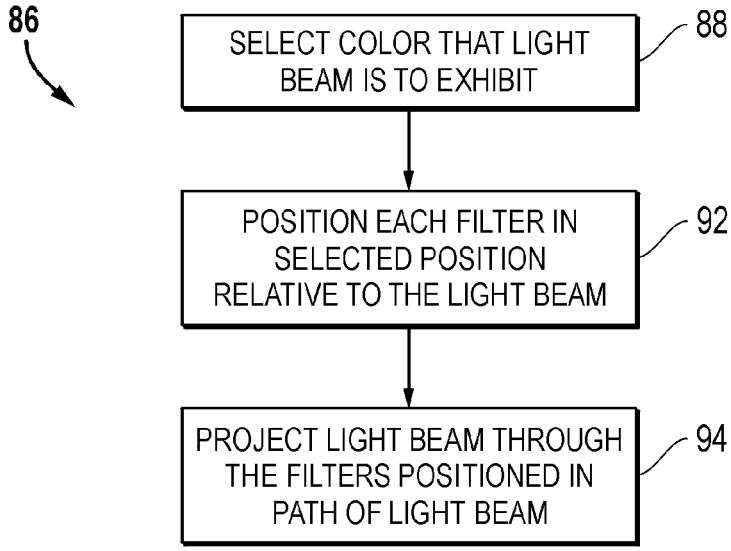
FIG. 6 illustrates a method flow diagram representative of the method of operation of an embodiment of the present invention.

FIG. 6 illustrates a method flow diagram, shown generally at 86, representative of the method of operation of an embodiment of the present invention. The method facilitates formation of a light beam that exhibits selected color characteristics. First, and as indicated by the block 88, selection is made of the color that the light beam is to exhibit. Then, and as indicated by the block 92, selectably position each dichroic filter in a selected position relative to the light beam generated by the housing assembly. And, as indicated by the block 94, the light beam is projected through the dichroic filters that filter the light beam and form a resultant, filtered light beam of desired color characteristics.

Because the color characteristics of the light beam generated by the lighting assembly is easily changeable, merely by translating the dichroic filters to position a desired combination of filter portions in the path of the light beam, successive changes of light colors are readily implemented. The use of dichroic filters also advantageously increases the longevity of the lighting assembly as the dichroic filters are relatively unsusceptible to damage caused by heat.

The previous descriptions are of preferred examples for implementing the invention, and the scope of the invention should not necessarily be limited by this description. The scope of the present invention is defined by the following claims.

The invention claimed is:

1. Color-changing apparatus for a light assembly having a light source that generates a light beam in at least an axial direction, said color-changing apparatus comprising:

a first lens and a second lens spaced apart therefrom, the first lens and the second lens positioned in a path defined by an axial direction of the light beam;

at least a first filter flag formed of a first color, said first filter flag exhibiting along at least a portion of a length thereof a first range of first color-saturation gradations in the first color;

at least a first filter-flag positioner for supportively positioning said at least first filter flag at least selectably at an angle offset from the axial direction of the light beam, said first filter-flag positioner for translating said first filter flag selectably to position a selected portion thereof in the light beam, a light-beam characteristic of the light beam dependent upon which portion of said first filter-flag forms the selected portion selectably positioned in the light beam; and wherein said first filter flag is positionable by said first filter-flag positioner between the first lens and the second lens.

2. The color-changing apparatus of claim 1 wherein said at least the first filter flag comprises said first filter flag and at least a second filter flag, said second filter flag of a second color and exhibiting, along at least a portion of a length thereof, a second range of second color-saturation gradations in the second color.

3. The color-changing apparatus of claim 2 wherein said at least first filter-flag positioner comprises said first filter-flag positioner and at least a second filter-flag positioner, said second filter-flag positioner for supportively positioning said second filter flag at an angle offset from the axial direction of the light beam, said second filter-flag positioner for translating said second filter flag selectably to position a selected portion thereof in the light beam, the light-beam characteristic of the light beam further dependent upon which portion of said filter flag forms the selected portion of the second filter flag positioned in the light beam.

4. The color-changing apparatus of claim 3 wherein said at least second filter flag comprises said second filter flag and at least a third filter flag, said third filter flag of a third color and exhibiting, along at least a portion of a length thereof, a third range of third color-saturation gradations in the third color.

5. The color-changing apparatus of claim 4 wherein said at least second filter-flag positioner comprises said second filter-flag positioner and at least a third filter-flag positioner, said third filter-flag positioner for supportively positioning said third filter flag at an angle offset from the axial direction of the light beam, said third filter-flag positioner for translating said third filter-flag selectably to a position a selected portion thereof in the light beam, the light beam characteristic of the light beam farther dependent upon which portion of said third filter flag forms the selected portion of the third filter flag positioned in the light beam.

6. The color-changing apparatus of claim 5 wherein the first color of which said first filter is formed comprises cyan, wherein the second formed comprises yellow, and wherein the third color of which said third filter is formed comprises magenta.

7. The color-changing apparatus of claim 1 wherein said at least the flag filter flag comprises a dichroic filter.

8. The color-changing apparatus of claim 1 wherein changes in the first color-saturation gradations extend in a linear direction along the at least the portion of the length of said first filter flag.

9. The color-changing apparatus of claim 1 wherein the angle offset from the axial direction at which said first filter-flag positioner supportively positions said first filter flag comprises a substantially perpendicular angle, substantially perpendicular to the axial direction of the light beam.

10. The color-changing apparatus of claim 1 wherein said first filter flag positioner further comprises a linear translation actuator for actuating translation of said first filter flag to position the selected portion of said first filter flag in the light beam.

11. The color-changing apparatus of claim 10 wherein the linear translation actuator of said first filter flag positioner is selectably actuable in a first direction and in a second direction, reverse of the first direction.

12. The color-changing apparatus of claim 10 wherein said filter-flag positioner comprises a carrier frame, positionable about selected side surfaces of said first filter flag and wherein the linear translation actuator comprises an actuator having an actuation arm attached to a side of the carrier frame.

13. Color-changing apparatus for a light assembly having a light source that generates a light beam in at least an axial direction, said color-changing apparatus comprising:

at least a first filter flag formed of a first color, said first filter flag exhibiting along at least a portion of a length thereof, a first range of first color-saturation gradations in the first color, the first range of the first color-saturation gradations extending along the first filter flag to define a less saturated region of the first portion and a more saturated region; and said first filter flag further comprising a second portion, the second portion exhibiting a first selected constant saturation level; and at least a first filter-flag positioner for supportively positioning said at least first filter flag at least selectably at an angle offset from the axial direction of the light beam, said first filter-flag positioner for translating said first filter flag selectably to position a selected portion thereof in the light beam, a light-beam characteristic of the light beam dependent upon which portion of said first filter-flag forms the selected portion selectably positioned in the light beam.

14. The color-changing apparatus of claim 13 wherein said first filter flag further comprises a third portion, the third portion exhibiting a third selected constant saturation level.

15. A method for selectably changing a color of a light beam generated at a light source of a light assembly, the light beam generated in at least an axial direction, said method comprising:

positioning an optical assembly comprising at least two lens in a path defined by the axial direction of the light beam;

supportively positioning a single first filter flag at least selectably at an angle offset from the axial direction of the light beam between the two lens and moveable across the light beam, the single first filter flag formed of a single first color, and the first filter flag exhibiting along at least a portion of a length thereof, a first range of first color-saturation gradations in the first color; and supportively positioning a single second filter flag in the light beam between the two lenses and moveable across the light beam, a light-beam characteristic of the light beam dependent upon positioning of the single first filter flag and the single second filter flag is positioned in the light beam to integrate the light and to provide a single color output beam.

16. The method of claim 15 wherein said operations of supportively positioning are independent of each other.

17. The method of claim 15 wherein the single first filter flag and the single second filter flag are supportively positioned during said operations of supportively positioning at a common side of the light beam generated by the light source.

18. The method of claim 15 wherein at least one of the single first filter flag and the single second filter flag includes an opaque portion.

19. Apparatus for selectably altering characteristics of a light beam generated by a light source of a light assembly, said apparatus comprising:

a first filter flag having a first part and at least a second part, the first part of the said first filter flag exhibiting first color characteristics and the second part of said first filter flag exhibiting second color characteristics, any of the first part and the at least the second part of said first filter flag positionable in the light beam;

a second filter flag having a first part and at least a second part, the first part of said second filter flag exhibiting third color characteristics and the second filter flag exhibiting fourth color characteristics, any of the first part and the at least the second part of said second filter flag also positionable in the light beam, selection of which parts of said first and second filter flags, respectively, positioned in the light beam determinative of lighting characteristics thereof; said first and second filter flags selectably positionable through sliding, linear translation along an axis substantially perpendicular to the light beam.

20. Color-changing apparatus for a light assembly having a light source that generates a light beam in at least an axial direction, said color-changing apparatus comprising:

a first lens positioned in-line with the light beam, said first lens for redirecting light energy of the light beam incident thereon in directions generally parallel to the axial direction of the light beam;

a filter flag formed of at least a first color supportively positioned, through linear translation, at an angle direction offset from the axial direction of the light beam and in-line with the light beam, once redirected by said first lens, said filter flag for coloring the light beam;

a second lens positioned in-line with the light beam, once colored by said filter flag, said second lens for shaping the light beam in a desired manner; and a linear translation actuator for actuating translation of said filter flag to position a selected portion of said filter flag in the light beam.

21. A color-changing apparatus for a light assembly having a light source that generates a beam in at least an axial direction, said color-changing apparatus comprising:

a light source producing a light source light beam;

an optical assembly comprising at least two lens groups positioned in a path defined by the axial direction of the light beam;

a single first filter flag formed of a single first color supported between the two lenses so as to be moveable across said light beam;

a second single filter flag formed of a second single color supported between the two lenses so as to be movable across said light beam;

wherein said single first filter flag is positioned between the two lenses of the optical assembly so as to integrate the light and provide a single color output beam.

22. The apparatus of claim 21 where the single first filter flag is of a first primary color.

23. The apparatus of claim 21 where the single first filter flag exhibits along at least a portion thereof a first range of first color-saturation gradations in the color.

24. The apparatus of claim 21 where the second single filter flag is of a second primary color.

25. The apparatus of claim 21 where the single first filter flag comprises a dichroic filter.

26. The apparatus of claim 21 where the light output is soft focused and does not produce a defined image.

27. The apparatus of claim 21 where the light output is hard focused and produces a defined image.

28. The apparatus of claim 21 where at least a third single filter flag formed of a single third color supported so as to be moveable across said light beam is additionally positioned between the two lenses.

29. The apparatus of claim 28 where the third single filter flag is of a third primary color.

30. The apparatus of claim 28 wherein the three single filter flags are serially arranged and, comprise, respectively, Cyan, Magenta and Yellow filters.

* * * * *